US008202072B2

(12) United States Patent
Schneider et al.

(10) Patent No.: US 8,202,072 B2
(45) Date of Patent: Jun. 19, 2012

(54) LUBRICANT-TIGHT VANE ROTARY VACUUM PUMP

(75) Inventors: Thomas Schneider, Wetzlar (DE); Juergen Wagner, Mueschenbach (DE)

(73) Assignee: Pfeiffer Vacuum GmbH, Asslar (DE)

( * ) Notice: Subject to any disclaimer, the term of this patent is extended or adjusted under 35 U.S.C. 154(b) by 692 days.

(21) Appl. No.: 12/001,716

(22) Filed: Dec. 11, 2007

(65) Prior Publication Data

US 2008/0145257 A1 Jun. 19, 2008

(30) Foreign Application Priority Data

Dec. 13, 2006 (DE) ..... 10 2006 058 839

(51) Int. Cl.
*F01C 21/04* (2006.01)
*F04C 15/00* (2006.01)
*F04C 29/02* (2006.01)

(52) U.S. Cl. ..... 418/97; 418/83; 418/100; 418/75; 418/76; 418/79; 55/424

(58) Field of Classification Search ..... 418/5, 7, 418/11, 13, 210, 215, 75–83, 92, 95, 96–100, 418/DIG. 1; 55/424
See application file for complete search history.

(56) References Cited

U.S. PATENT DOCUMENTS

| | | | | | |
|---|---|---|---|---|---|
| 1,672,205 | A | * | 6/1928 | Eisler | 418/13 |
| 1,879,136 | A | | 11/1929 | Dubrovin | |
| 1,890,614 | A | * | 12/1932 | Klopsteg | 418/11 |
| 2,337,849 | A | * | 12/1943 | Dubrovin | 418/13 |
| 2,877,946 | A | * | 3/1959 | Garrison et al. | 418/13 |
| 2,902,210 | A | * | 9/1959 | Power | 418/13 |
| 3,178,102 | A | * | 4/1965 | Grisbrook | 417/406 |
| 3,191,854 | A | * | 6/1965 | Lowler et al. | 418/85 |
| 3,438,570 | A | * | 4/1969 | Gladbach et al. | 418/13 |
| 3,649,140 | A | | 3/1972 | Harlin | |
| 3,809,511 | A | | 5/1974 | Linder et al. | |
| 4,358,247 | A | * | 11/1982 | Suzuki et al. | 417/13 |
| 4,415,319 | A | * | 11/1983 | Masuda et al. | 418/135 |
| 4,838,772 | A | * | 6/1989 | LeBlanc | 418/13 |
| 5,178,522 | A | * | 1/1993 | Abelen et al. | 417/410.1 |
| 5,242,280 | A | * | 9/1993 | Fujio | 418/11 |
| 5,372,489 | A | * | 12/1994 | Matsuda et al. | 418/13 |
| 5,769,617 | A | * | 6/1998 | Glen | 418/13 |
| 5,879,138 | A | * | 3/1999 | Arndt et al. | 417/244 |
| 6,929,455 | B2 | * | 8/2005 | Dreiman et al. | 417/410.3 |
| 6,953,490 | B2 | * | 10/2005 | Bush | 418/DIG. 1 |
| 7,290,994 | B2 | * | 11/2007 | Kitaichi et al. | 418/60 |
| 7,303,379 | B2 | * | 12/2007 | Ebara et al. | 418/11 |
| 7,462,021 | B2 | * | 12/2008 | Ebara et al. | 418/60 |
| 2004/0105772 | A1 | | 6/2004 | Lee et al. | |

FOREIGN PATENT DOCUMENTS

| | | |
|---|---|---|
| DE | 0121823 | 8/2002 |
| GB | 0385720 | 1/1933 |
| JP | 03 141886 | 6/1991 |

* cited by examiner

*Primary Examiner* — Mary A Davis
(74) *Attorney, Agent, or Firm* — Abelman, Frayne & Schwab

(57) ABSTRACT

A lubricant-tight vane rotary vacuum pump, includes a pump stage (17) having a pump stage housing (10) with a gas inlet, compression chamber (11), and a gas outlet (51), a channel (50) connecting the compression chamber (11) with the gas outlet (51), and a groove (54) at least partially surrounding a mouth of the connecting channel (50) that opens into the gas outlet (51), so that lubricant, which is tossed out of the compression chamber, is collected in the groove (54) and re-entry of the lubricant back into the compression chamber (11) is prevented.

6 Claims, 3 Drawing Sheets

LUBRICANT-TIGHT VANE ROTARY VACUUM PUMP

BACKGROUND OF THE INVENTION

1. Field of the Invention

The present invention relates to a lubricant-tight vane rotary vacuum pump having a pump stage including a pump stage housing having inlet and outlet, and a compression chamber located in the housing.

2. Description of the Prior Art

Lubricant-tight vane rotary vacuum pumps are used for many years in many industries for producing low and high vacuum. In addition to traditional requirements the vacuum technology should meet, modern vane rotary vacuum pumps should have additional characteristics one of which is a reduced operating noise generated by a pump and transmitted to the environment.

European Publication EP-A 1 696 131 suggests to arrange a vane rotary vacuum pump in an external housing to noise-isolate the pump. The problem with this solution is high costs of the external housing and a danger of the pump, which is enclosed in a small closed volume, to overheat during operation.

Accordingly, the object of the invention is to provide a cost-effective construction of a vane rotary vacuum pump that would have a reduced noise.

SUMMARY OF THE INVENTION

This and other objects of the present invention which will become apparent further below, are achieved by providing a lubricant-tight vane rotary vacuum pump including a pump stage having a pump stage housing with gas inlet, compression chamber, and gas outlet, a channel connecting the compression chamber with the gas outlet, and a groove at least partially surrounding a mouth of the connecting channel that opens into the gas outlet. Thereby, lubricant, which is tossed out of the compression chamber, is collected in the groove so that re-entry of the lubricant back into the compression chamber is prevented.

The groove that surrounds the connecting channel mouth substantially reduces the generated noise.

The lubricant, which is tossed out of the compression chamber to the outlet becomes substantially degassed at pressures in vicinity of operational pressures of a vane rotary vacuum pump. Also, the channel and the gas outlet are also without gas to a large extent, so that the lubricant, without being damped by gas, strikes the housing parts, generating noise.

Particularly high noise is generated by lubricant that falls back into the compression chamber. The present invention prevents the lubricant from falling back into the compression chamber, with the lubricant being collected in the groove.

According to a first modification, the gas outlet is formed as a cylindrical chamber having a first diameter, and the channel is formed as a cylindrical bore having a second diameter. Thereby, a groove is formed. Cylindrical shapes are particularly easily formed by bores. Expensive milling processes are eliminated according to a further modification of the invention according to which, the pump includes a ring arranged at an end of the connecting channel adjacent to the gas outlet and projecting into the gas outlet. The groove is formed between the ring and the pump stage housing.

According to an advantageous embodiment of the invention, the ring is formed as a tension ring having, in a release position, a diameter greater than the diameter of the channel.

As a result, upon insertion of the ring into a channel, the tendency of the tension ring to expand produces a preload that insures a reliable retention of the ring in the channel.

According to a further development of the invention, there is provided a gas conduit for delivery of gas from the pump inlet to the gas inlet in the housing of the pumping stage. The delivery gas conduit has an axis that extends at least sectionwise, neither parallel to the shaft axis nor lies on a plane parallel to the shaft axis. Such position of the delivery conduit insures a cost-effective manufacturing of the conduit and provides for an optimal short connection of the pump inlet with the pump stage inlet. Thereby, the conductance and, thus, the vacuum characteristics are improved.

The novel features of the present invention which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
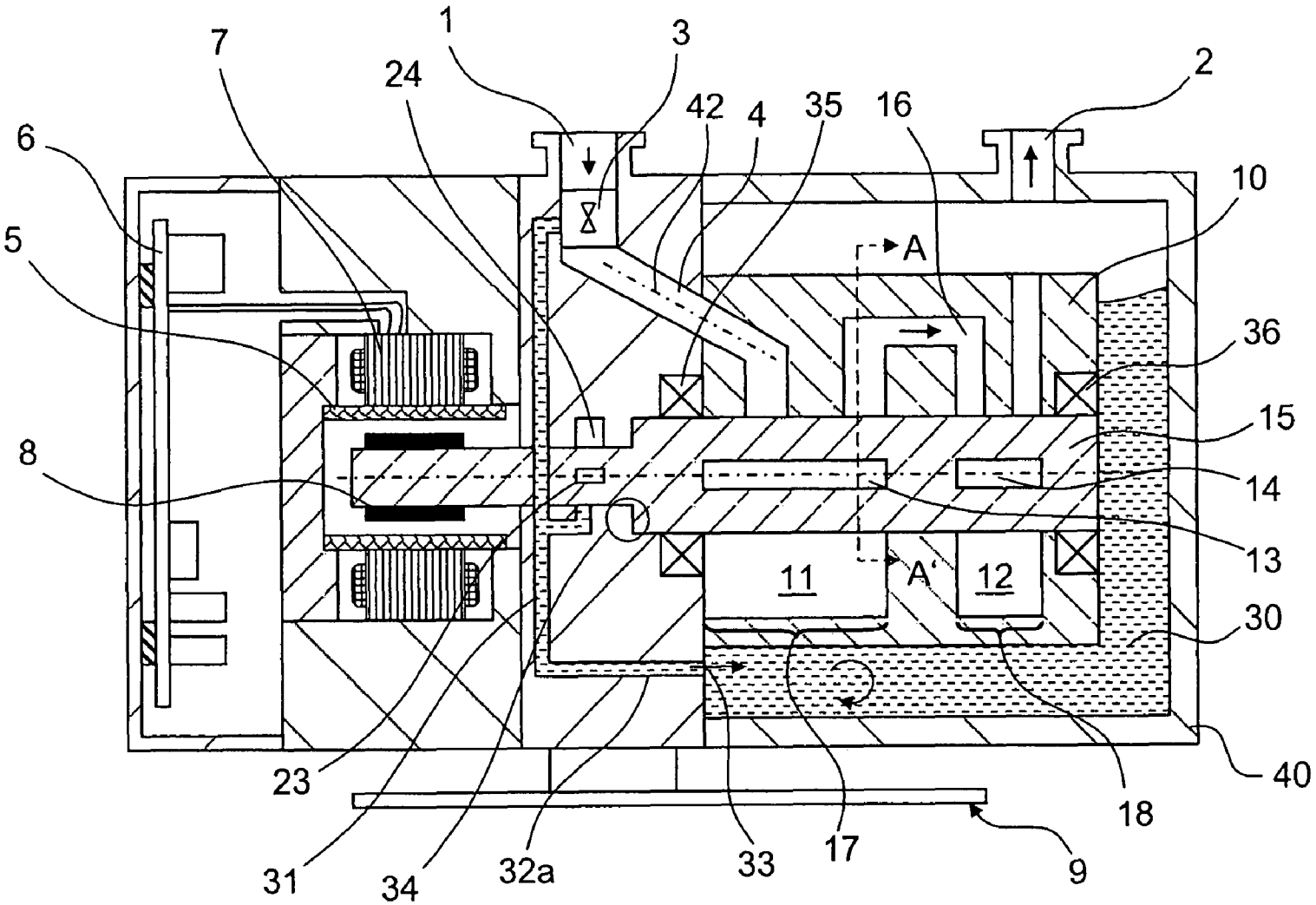
FIG. 1 a vertical cross-sectional view of a lubricant-tight vane rotary vacuum pump according to the present invention along the shaft axis.

In a lubricant-tight vane rotary vacuum pump according to the present invention, which is shown in FIG. 1 and which will be referred to further below simply as a vacuum pump, gas enters the pump through a pump inlet 1, is compressed in the pump interior, and is ejected through a pump outlet 2. Immediately behind the gas inlet 1, in the gas flow direction, there is provided a hydraulically operated safety valve 3. The lubricant of the vacuum pump causes opening of the safety valve 3 as soon as it is subjected to pressure. A gas conduit 4 connects the safety valve 3 with the compression chamber 11 of the first pump stage 17, so that the gas can reach the compression chamber 11 from the pump inlet 2 as soon as the safety valve 3 opens. The pump stage 17 is arranged in a pump stage housing 10 that is at least partially surrounded by lubricant located in a lubricant reservoir 30. In the cylindrical compression chamber 10, a rotatable vane 13 is located. The rotation of the vane 13 is effected by a rotatable shaft 15 that extends eccentrically through the compression chamber 11. The shaft 15 has a slot, in which a vane is secured, for each pump stage. Between the vane and the compression chamber, there is formed a sickle-shaped space that periodically increased or decreased as a result of rotation of the vane, resulting in a pumping action. The compressed gas is fed through a by-pass conduit 16 into a second pump stage 18 and its compression chamber 12 in which a rotatable vane 14 is located. The gas is further compressed and then is finally ejected.

The shaft 15 is driven by a motor that includes, in the embodiment of the pump shown in the drawings, permanent magnets 8 secured on the shaft 15, and a stationary coil 7 that produces a rotatable magnetic field which causes the rotation of the shaft 15. A separation member 5 hermetically separates the coil 7 from the shaft 15. Control electronics 6 is connected with the coil 7 by appropriate conductors, communicating power to the coil 7. The present invention can also be used in vacuum pump having a different type of a motor, e.g., an asynchronous meter.

The shaft 15 is supported by a slide bearing 35 which is located between the motor and the first pump stage 17, and an end slide bearing 36 provided at an end of the shaft 15 on a side of the second pump stage 18 remote from the first pump stage 17.

Between the motor and the first pump stage 17, there is provided a lubricant pump. The lubricant pump includes a rotatable vane 23 located in a compression chamber 24 of the lubricant pump and driven by the shaft 15. The lubricant from the lubricant pump is fed into a hydraulic conduit 31 that in the drawing, for clarity sake, is shown in front of the cross-sectional plane.

Between the lubricant pump and the first stage 17, there is provided a lubricant flow resistance 34. The object of the flow resistance 34 is to make the flow of the pressurized lubricant that exits the lubricant pump, in the direction of the first pump stage 17 more difficult. The flow needs not to be completely prevented as even a small amount of the lubricant is sufficient for lubrication of the slide bearing 35. In the embodiment shown in the drawings, the flow resistance 34 is formed as a step in the shaft 15 formed by changing the shaft diameter. In addition, the surface of the shaft can be provided with an appropriate structure, e.g., with grooves. Advantageously, the grooves can be formed as a helically extending grooves on the shaft surface, providing a delivery path extending in a direction opposite the flow direction of the lubricant.

The lubricant reservoir 30 serves for storing a large amount of lubricant. The lubricant forms, together with the lubricant in the compression chamber, bearings, and the safety valve, a circulation loop and serves for exchange of the lubricant. A horizontal conduit section 32*a* that adjoins the hydraulic conduit 31 opens in the lubricant reservoir 30 at the conduit mouth 33, with the lubricant, which is pressurized by the lubricant pump, exiting the conduit section 32*a*. This exiting flow causes movement of the lubricant contained in the lubricant reservoir 30. Thereby, warm lubricant, which is located adjacent to the surface of the housing 10 of the first pump stage 17, leaves the reservoir 30 and flows to a pump stage housing 40 of the second pump stage 18. There, the lubricant gives up its heat. Thereby, the temperature of the lubricant is reduced, and its service life increases, as few chemical decomposition processes take place. The movement of the lubricant is shown with a circular arrow.

Figure 2:
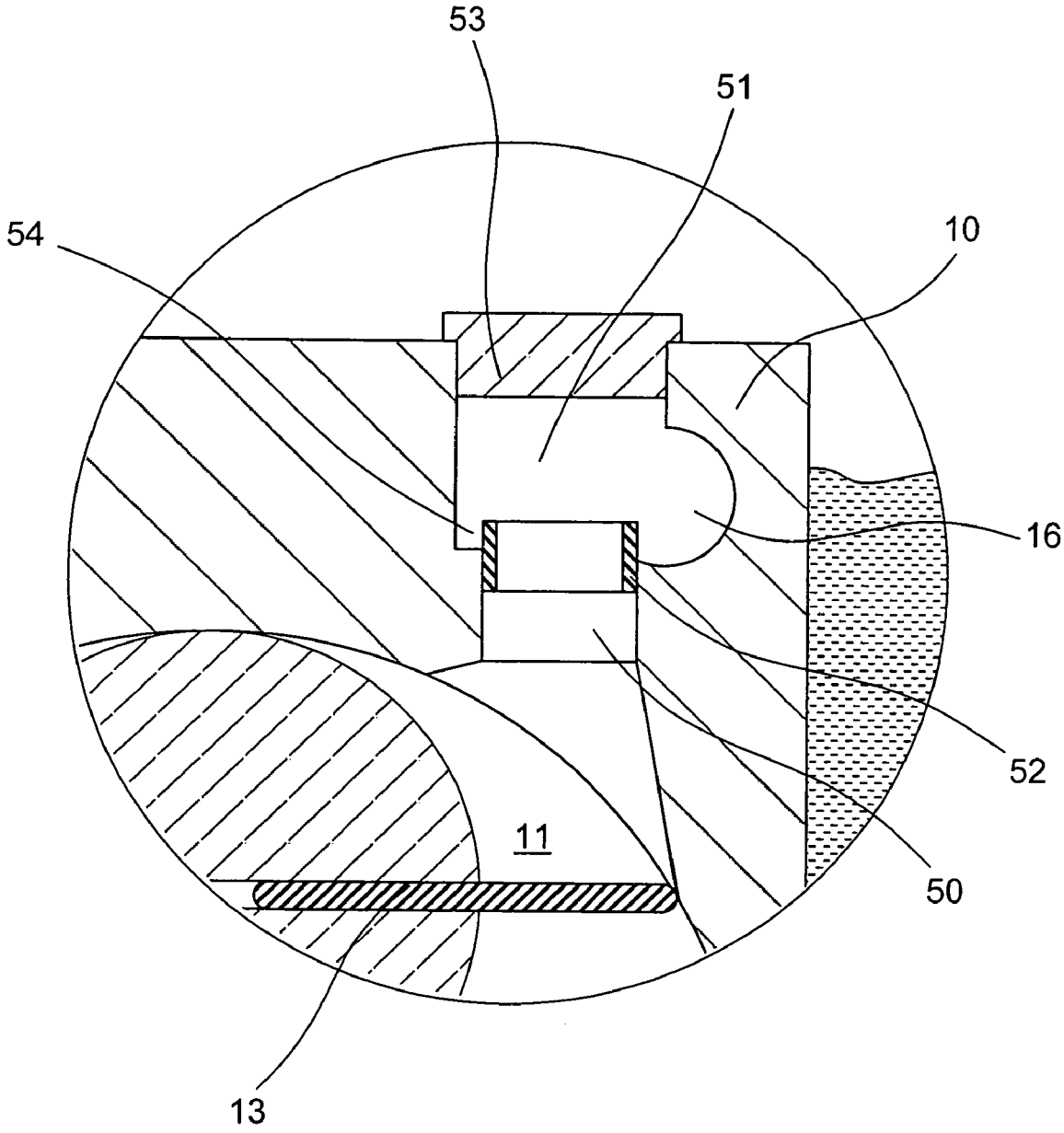
FIG. 2 a cross-sectional view of the inventive vane rotary vacuum pump shown in FIG. 1 along line A-A'.

FIG. 2 shows the region of the gas outlet 2. The pump stage housing 10 includes a gas outlet 51 through which the compressed gas flows in the by-pass conduit 16. The by-pass conduit 16 is formed as a bore having a first diameter. A cover 53 closes the bore. A channel 50, which is also formed as a bore having a second diameter, connects the compression chamber 11 with the gas outlet 51. At the end of the channel 50, a ring 52 is so set in the channel that it projects in the gas outlet 51. Thereby, a groove 54 is formed. Lubricant, which is tossed by the vane 13 into the channel 50, is collected in the groove 54. In another embodiment, the groove can be formed by a corresponding shape of the pump stage housing 10 in the region of the mouth of the channel 50. According to an advantageous modification, the ring 52 is formed a tension ring which has, in a release condition, a diameter greater than the diameter of the channel 50. As a result, after the insertion of the tension ring in the channel, a preload is provided caused by the tendency of the tension ring to expand. This preload insures a reliable retaining of the tension ring in the channel.

Figure 3:
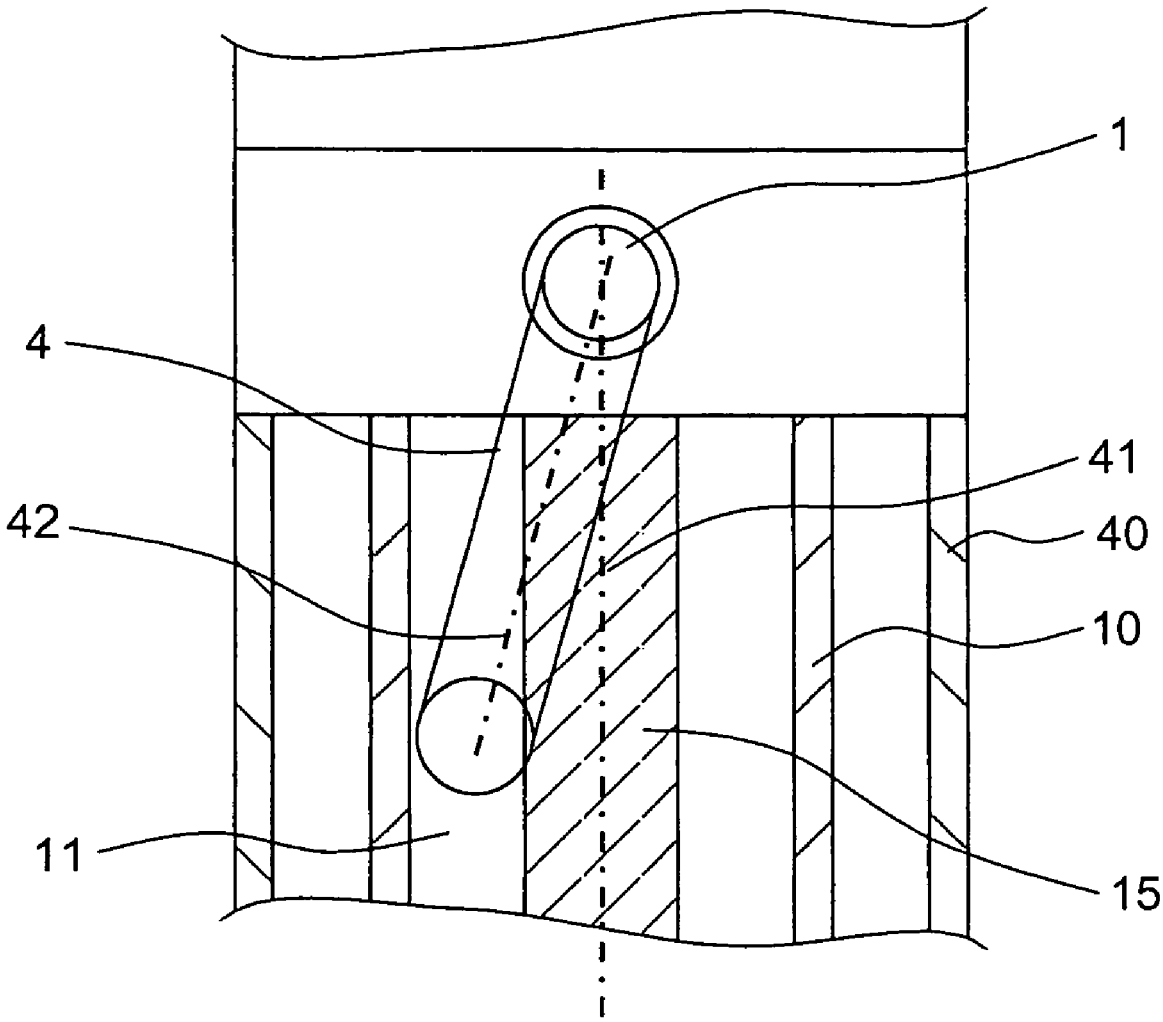
FIG. 3 a partially transparent view of the inventive vane rotary vacuum pump with view in the direction of a gas inlet.

FIG. 3 clarifies the course of the gas conduit 4 in the pump, with the section of the pump being shown partially transparent. The gas conduit 4 is formed, at least sectionwise, as a bore an axis 42 of which is inclined to the shaft axis 41, i.e., forms, with the shaft axis 41, an angle of more than 0°. With reference also to FIG. 1 in which the axis 42 is also shown, it should be clear that axis 42 is neither parallel to the shaft axis 41 nor lies in a plane parallel to the shaft axis 41. The gas conduit 4, as it has already been discussed above, connects the gas inlet 1 with the compression chamber 11. Such formation of the gas conduit 4 provides for an optimal short path from the pump inlet 1 and the inlet of the first pump stage 17. With a short gas path, conductance and vacuum characteristics are improved.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A lubricant-tight vane rotary vacuum pump, comprising a first pump stage (17) having a pump stage housing (10) with gas inlet, first compression chamber (11) and first stage gas outlet (51); a channel (50) connecting the first compression chamber (11) with the first stage gas outlet (51) and having a mouth that opens into the first stage gas outlet (51); and preventing means provided at the first stage gas outlet (51) for preventing re-entry of lubricant, which is tossed out of the first compression chamber (11), back into the first compression chamber.

2. A vacuum pump according to claim 1, wherein the channel (50) has a cross-section smaller than a cross-section of the first stage gas outlet (51), and wherein the preventing means comprises a groove (54) completely surrounding the mouth of the connecting channel (50) for collecting lubricant which is tossed out of the first compression chamber.

3. A vacuum pump according to claim 2, wherein the groove (54) is located, at least partially in the first stage gas outlet (51).

4. A vacuum pump according to claim 3, comprising a ring (52) arranged at an end of the channel (50) adjacent to the first stage gas outlet (51) and projecting into the first stage gas outlet (51) with the groove (54) being formed between the ring (52) and the pump stage housing (10).

5. A vacuum pump according to claim 4, wherein the ring (52) comprises a tension ring.

6. A vacuum pump according to claim 3, comprising a gas conduit (4) for delivery of gas to the gas inlet of the pump stage housing (10) and having an axis (42), a shaft (15) for supporting vanes and having an axis (42), wherein the gas conduit axis (42) extends, at least section wise, neither parallel to the shaft axis (42) nor lies on a plane parallel to the shaft axis (42).

* * * * *